United States Patent [19]

Rowe et al.

[11] Patent Number: 4,971,153

[45] Date of Patent: Nov. 20, 1990

[54] METHOD OF PERFORMING WIRELINE PERFORATING AND PRESSURE MEASUREMENT USING A PRESSURE MEASUREMENT ASSEMBLY DISCONNECTED FROM A PERFORATOR

[75] Inventors: Wayne S. Rowe, West Minister; E. Allen Klingensmith, Littleton, both of Colo.

[73] Assignee: Schlumberger Technology Corporation, Houston, Tex.

[21] Appl. No.: 441,117

[22] Filed: Nov. 22, 1989

[51] Int. Cl.[5] ..... E21B 47/06; E21B 29/00; E21B 23/00

[52] U.S. Cl. ..... 166/297; 166/113; 166/250; 166/381; 166/385

[58] Field of Search ..... 166/250, 297, 377, 381, 166/385, 113, 55.1; 175/4.53, 4.57; 73/151, 155

[56] References Cited

U.S. PATENT DOCUMENTS

| | | | |
|---|---|---|---|
| 3,087,552 | 4/1963 | Graham | 166/381 |
| 4,349,072 | 9/1982 | Escaron et al. | 166/297 |
| 4,423,625 | 1/1984 | Bostic, III. et al. | 166/250 |
| 4,506,731 | 3/1985 | Skinner | 166/250 |
| 4,598,771 | 7/1986 | Vann | 166/750 |
| 4,669,537 | 6/1987 | Rumbaugh | 166/385 |
| 4,690,214 | 9/1987 | Wittrisch | 166/385 |
| 4,718,493 | 1/1988 | Hill et al. | 166/385 |
| 4,828,051 | 5/1989 | Titchener et al. | 166/250 |

*Primary Examiner*—Bruce M. Kisliuk

*Attorney, Agent, or Firm*—Henry N. Garrana; John H. Bouchard

[57] ABSTRACT

A method of perforating includes lowering a perforator and attached pressure measurement gauge assembly into a wellbore on wireline until the gauge assembly touches a bottom of the wellbore. Continued lowering of the wireline into the wellbore produces a slack on the wireline, the slack allowing the perforator to disconnect from the gauge assembly. The perforator is pulled uphole until the perforator is within a predetermined distance from the gauge assembly. Further pulling of perforator uphole ceases. The perforator is ready to be detonated. When well fluid is produced from the formation, the gauge assembly, resting on the wellbore bottom, records the pressure of the well fluid flowing from the formation. The perforator is retrieved from the wellbore. When it is desired to retrieve the gauge assembly from the bottom of the wellbore, a retrieving assembly is lowered into the wellbore by either wireline or sandline, the retrieving assembly connecting to the gauge assembly. The gauge assembly is pulled uphole to the well surface and the pressure measurement records are read and further recorded.

16 Claims, 2 Drawing Sheets

METHOD OF PERFORMING WIRELINE PERFORATING AND PRESSURE MEASUREMENT USING A PRESSURE MEASUREMENT ASSEMBLY DISCONNECTED FROM A PERFORATOR

BACKGROUND OF THE INVENTION

The subject matter of the present invention relates to perforating techniques in oil well boreholes, and more particularly, to a method of performing a wireline perforation operation in combination with pressure measurement using a perforating gun disposed on wireline for performing the perforation operation and a gauge assembly disconnected from the perforating gun for performing the pressure measurement function.

When a perforating gun, disposed on wireline, perforates a borehole formation, a well fluid is produced from the formation. A gauge assembly is adapted for measuring a pressure of the well fluid produced from the formation. If the gauge assembly is lowered into the borehole on the same wireline which is connected to the perforating gun, when the perforating gun detonates, a mechanical shock wave is produced, the shock wave propagating along the wireline and adversely affecting the performance of the attached gauge assembly. In some cases, the gauge assembly is destroyed as a result of the received mechanical shock. An alternate design is needed for performing a combined wireline perforation and pressure measurement function without simultaneously damaging the pressure measurement gauge assembly during the perforation operation.

SUMMARY OF THE INVENTION

Accordingly, it is a primary object of the present invention to provide an apparatus and method for performing a combined wireline perforation and pressure measurement operation while preventing any damage, or at least reducing the amount of damage, to the pressure measurement gauge assembly during the perforation operation resultant from a mechanical shock wave originating from the perforator of the apparatus.

It is a further object of the present invention to provide a method for performing a combined perforation and pressure measurement operation wherein a pressure gauge assembly is physically separated from the perforating gun prior to detonation of the perforating gun in a borehole thereby preventing damage or at least limiting the amount of damage to the pressure gauge assembly resultant from a mechanical shock wave originating from the perforating gun.

In accordance with these and other objects of the present invention, a pressure measurement gauge assembly and a perforator are lowered into a borehole by wireline, the gauge assembly being disposed below the perforator on the wireline. When the gauge assembly contacts the bottom of the borehole, further tension on the wireline is reduced until a specific amount of wireline slack is produced. This reduced tension on the wireline releases the gauge assembly from the perforator. A pull on the wireline increases tension on the wireline and raises the perforator. When the perforator is no more than a predetermined distance from the gauge assembly (e.g., perhaps within 200 to 500 feet from the gauge assembly), further pull on the wireline stops. The perforator is allowed to perforate the formation at this depth in the borehole while the pressure measurement gauge assembly is resting on the bottom of the borehole. When well fluid begins to flow from the perforated formation, the gauge assembly begins to measure the pressure of the well fluid. The perforating gun assembly is removed from the wellbore and the perforating truck at the well surface is released from the location. At some subsequent point in time, the gauge assembly may be retrieved from the well for recording the pressure readings.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
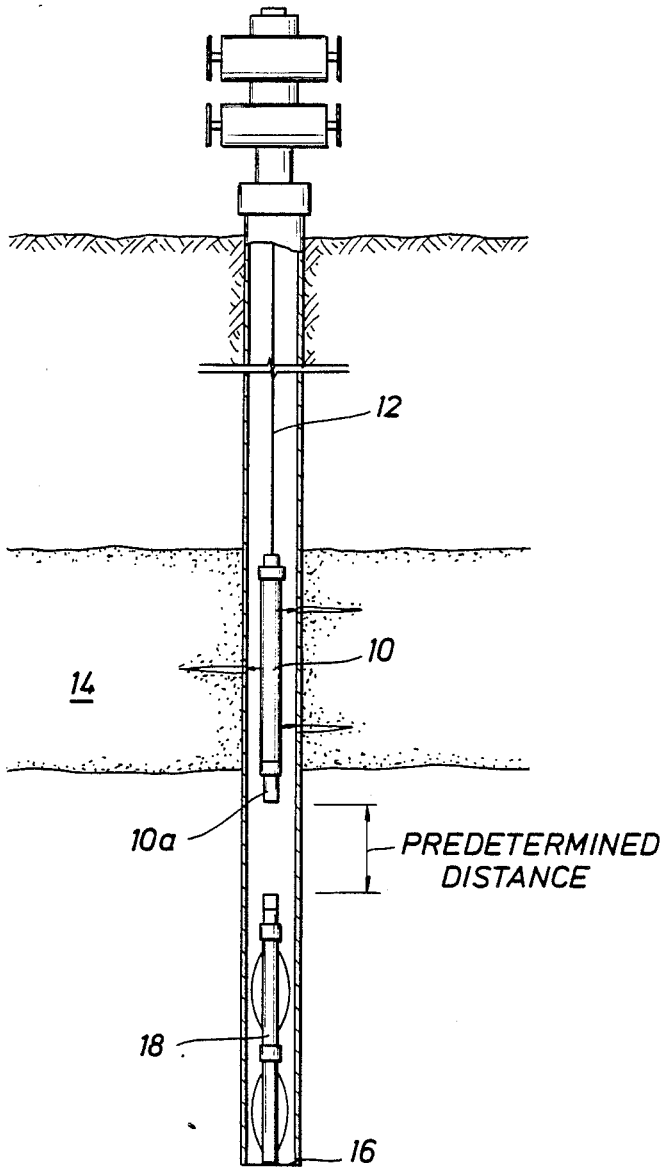
FIG. 1 illustrates a perforation and pressure measurement apparatus, disposed in a borehole, in accordance with one embodiment of the perforation and pressure measurement method and apparatus of the present invention.

Referring to FIG. 1, an apparatus in accordance with the present invention is illustrated. In FIG. 1, a perforator 10 is connected to wireline 12, the perforator 10 including a setting assembly **10*a*. The perforator 10 is shown disposed adjacent to a perforating zone 14. The perforating zone 14 is very close to the bottom 16 of the wellbore. A pressure measurement gauge assembly 18 is adapted to be connected to the setting assembly 10*a* of perforator 10, but is shown in FIG. 1 as resting on the bottom 16 of the wellbore. However, the gauge assembly 18 is located within a predetermined distance from the perforator 10 (e.g., perhaps within a distance of 200 to 500 feet from the perforator 10**).

The following method steps have already taken place, which steps resulted in the configuration of the apparatus shown in FIG. 1.

The pressure measurement gauge assembly 18 is connected to the perforator 10, the combined assembly 18/perforator 10 being connected to wireline 12. A user at the well surface lowers the assembly 18/perforator 10 into the wellbore by wireline 12 until the assembly 18 touches the bottom 16 of the wellbore. The user continues to reduce tension on wireline 12 by lowering the wireline 12 into the wellbore even though the assembly 18 is touching bottom 16 of the wellbore. This provides needed slack on the wireline, the slack and resultant reduced tension on wireline 12 releasing the assembly 18 from the perforator 10. When the assembly 18 is released from perforator 10, the user pulls on wireline 12 thereby raising the perforator 10 until it is within a predetermined distance from the pressure measurement gauge assembly 18 (e.g., within approximately 200–500 feet). When the apparatus of FIG. 1 is disposed near the bottom 16 of the wellbore and adjacent the perforating zone 14 as shown, the perforator 10 detonates thereby perforating the zone 14. Well fluids begin to flow from the perforating zone 14, and the pressure measurement gauge assembly 18 records the pressure of the well fluid. At some subsequent point in time, the perforator 10 is withdrawn to the well surface. After some predetermined elapsed time, the gauge assembly 18 is retrieved from the bottom of the well for a reading of the recorded pressure.

Figure 2:
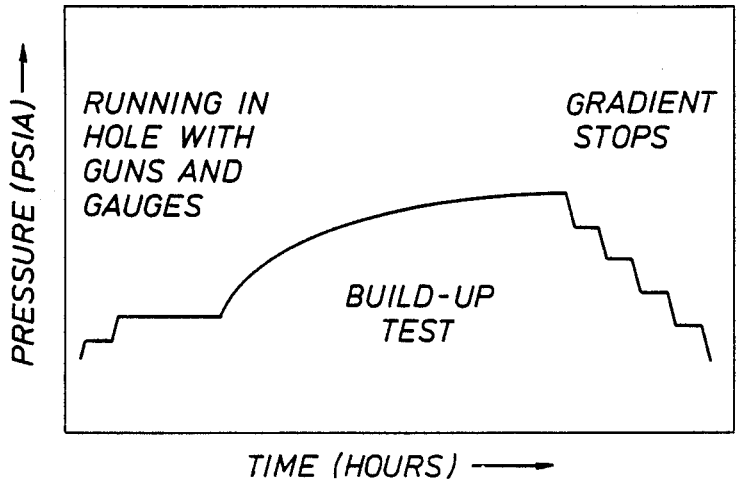
FIG. 2 illustrates a chart of pressure vs. time using the apparatus shown in FIG. 1.

Referring to FIG. 2, a pressure vs. time plot is illustrated showing a build up of pressure in the wellbore when the perforator 10 and pressure measurement assembly 18 is disposed in the wellbore as shown in FIG. 1. When the perforator 10 and gauge assembly 18 are run into the wellbore and disposed as shown in FIG. 1, a pressure build up is recorded on the pressure gauge assembly 18 when the well fluid begins to flow from the perforating zone 14. After the pressure begins to level off, the gauges are pulled. Stationary pressure measurements are made at regular intervals as the gauge assembly 18 is retrieved from the borehole to determine the density of the fluid in the wellbore as well as the type and quantity of fluids recovered during the pressure build up.

Figure 3:
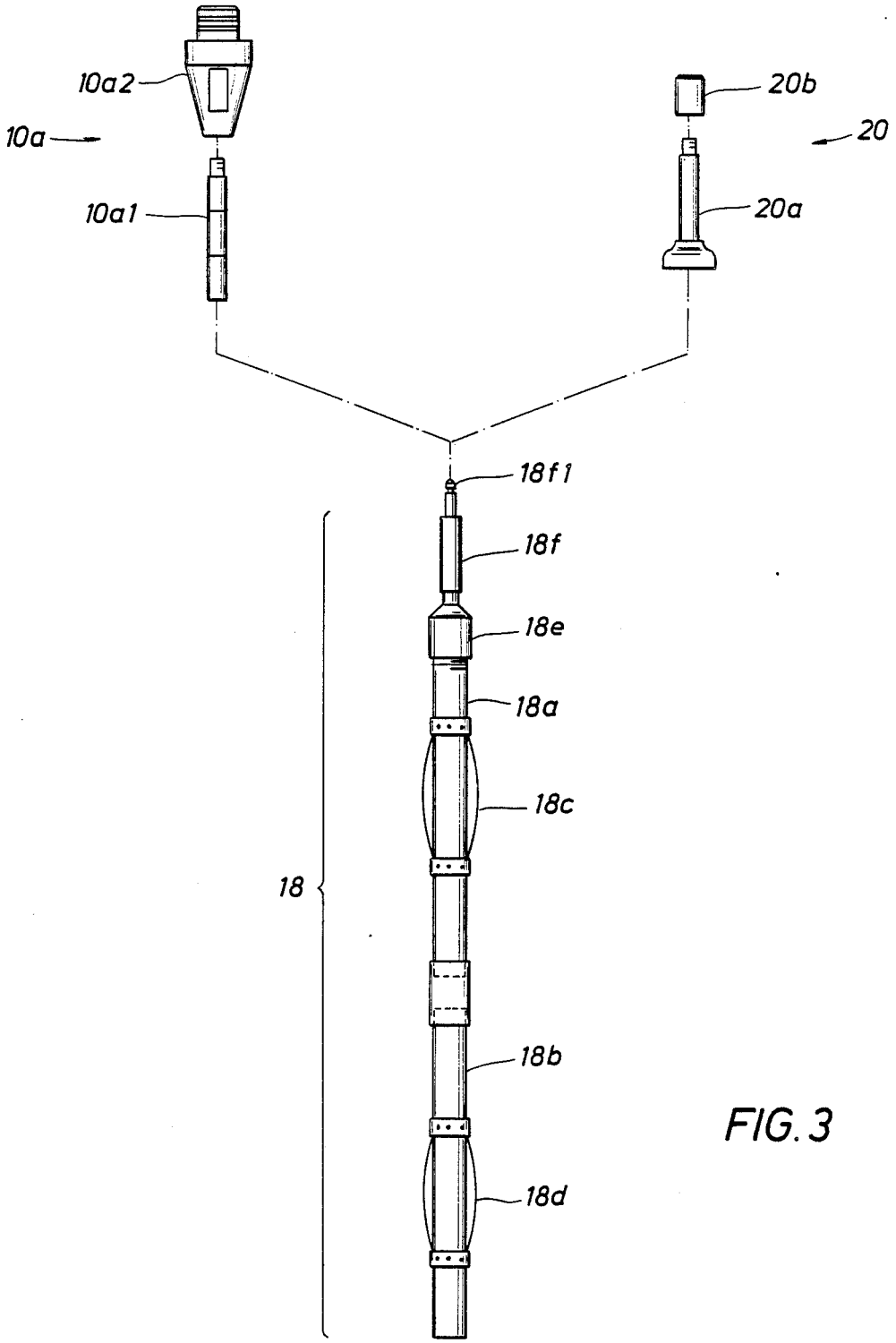
FIG. 3 illustrates in more detail the perforation and pressure measurement apparatus shown in FIG. 1 in accordance with the present invention.

Referring to FIG. 3, the setting assembly **10*a* and the pressure measurement gauge assembly 18 is illustrated. In addition, a retrieving assembly for retrieving the gauge assembly 18 from the wellbore following perforation, not shown in FIG. 1**, is also illustrated.

In FIG. 3, the pressure measurement gauge assembly 18 comprises a first pressure recorder **18*a* and a second pressure recorder 18*b*, the pressure recorders 18*a* and 18*b* being provided by Flopetrol Johnson, Inc, model number J-200. The first pressure recorder 18*a* is connected to a first centralizer 18*c* which locates or positions the gauge assembly 18 in the middle of the wellbore. The gauge assembly 18 is centralized in the casing in order to ease a subsequent retrieval of the assembly 18. The second pressure recorder 18*b* is connected to its own centralizer 18*d* that is identical to centralizer 18*c*. In the preferred embodiment, the centralizers 18*c* and 18*d* are purchased from GEMOCO. The first pressure recorder 18*a* is connected to an adapter sub 18*e*, the adapter sub 18*e* being connected to the bottom half of a soft set 18*f*. The soft set 18*f* includes a member 18*f*1 which is adapted for connection to a top half of soft set 10*a*1 associated with the setting assembly 10*a*, and is also adapted for connection to a fishing assembly of a retrieving assembly to be discussed below. The soft set 18*f* and 10*a*1 may be purchased from Cable, Inc. The setting assembly 10*a* includes the top half of soft set 10*a*1 discussed above and gun butt 10*a*2. The gun butt 10*a*2 is adapted for connection to the top half of soft set 10*a*1**, on one end, and to a standard perforating gun on its other end.

FIG. 3 also illustrates a retrieving assembly 20 which is used for connection to member **18*f*1 of the bottom half of soft set 18*f* when it is desired to retrieve the pressure measurement gauge assembly 18 from the wellbore following perforation by perforator 10. The retrieving assembly 20 includes a fishing assembly 20*a* and an adapter sub 20*b*. The fishing assembly 20*a* is adapted for connection to member 18*f*1 of the bottom soft set 18*f* when it is desired to retrieve the gauge assembly 18 from the wellbore following perforation. The adapter sub 20*b* is adapted for connection to a service rig sandline or wireline, the sandline or wireline, when connected to the adapter sub 20*b*, pulling on adapter sub 20*b*, the adapter sub 20*b* pulling on fishing assembly 20*a* in response thereto. When the fishing assembly 20*a* is connected to member 18*f*1 of the bottom soft set 18*f*, a pull on the fishing assembly tends to pull the gauge assembly 18 from its position at the bottom 16** of the wellbore.

A functional description of the present invention is set forth in the following paragraph with reference to FIGS. 1 and 3 of the drawings.

Perforator 10 is connected to wireline 12, on one end, and to the gun butt **10*a*2 of setting assembly 10*a* on the other end. The top half of soft set 10*a*1 of setting assembly 10*a* is connected to member 18*f*1 of the bottom soft set 18*f* of gauge assembly 18*f*. The user lowers wireline 12 and the attached perforator 10 and gauge assembly 18 into the wellbore until the gauge assembly 18 touches bottom 16 of the wellbore. Centralizers 18*c* and 18*d* position the gauge assembly 18 in the middle of the wellbore. Further continued lowering of wireline 12 into the wellbore produces a slack in the wireline 12. When this occurs, top half of soft set 10*a*1 of setting assembly 10*a* disconnects from member 18*f*1 of the bottom half of soft set 18*f* of gauge assembly 18. The user pulls the perforator 10 uphole until the perforator 10 is within a predetermined distance from the gauge assembly 18 (e.g., perhaps within 200 to 500 feet from the gauge assembly). At this point, the pulling of perforator 10 uphole must cease, at which point, the perforator 10 is ready for detonation and perforation of the perforating zone 14. When well fluid begins to flow from the zone 14, a pressure build up is experienced, as indicated in FIG. 2. The pressure recorders 18*a* and 18*b* begin recording the pressure of the well fluid flowing from the perforating zone 14. The user pulls the perforator 10 to the well surface. When the pressure records have been made by pressure recorders 18*a*/18*b*, the retrieving assembly 20 is lowered into the wellbore by wireline 12 (or by service rig sandline) until the fishing assembly 20*a* of retrieving assembly 20 contacts the member 18*f*1 of the bottom soft set 18*f* of gauge assembly 18. When this occurs, the fishing assembly 20*a* connects to the member 18*f*1 of the bottom soft set 18*f*, and the user is ready to pull the gauge assembly 18** to the well surface.

Since the gauge assembly is not connected to the perforator 10 when the perforator detonates, the mechanical shock wave produced from the perforator will not damage the gauge assembly (or at least, the damage to the gauge assembly will be significantly reduced).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of performing a perforating and pressure measurement function when an apparatus is lowered into a borehole, said apparatus including a perforator for performing the perforating function and a gauge assembly connected to the perforator for performing the pressure measurement function, said gauge assembly adapted to be lowered into said borehole ahead of said perforator when said apparatus is lowered into said borehole, comprising the steps of:

disconnecting said perforator from said gauge assembly when said gauge assembly contacts a bottom of said borehole; and raising said perforator uphole in said borehole, the raising step being terminated when said perforator is within a predetermined distance from said gauge assembly.

2. The method of claim 1, further comprising the step of:

using said perforator, perforating a formation adjacent said perforator; and receiving a well fluid flowing from said formation.

3. The method of claim 2, further comprising the step of:

using said gauge assembly resting on the bottom of said borehole, measuring a pressure of said well fluid.

4. The method of claim 3, further comprising the step of:

withdrawing said perforator from said borehole and leaving said gauge assembly resting on said bottom of said borehole.

5. The method of claim 4, further comprising the step of:

subsequently withdrawing said gauge assembly from said bottom of said borehole.

6. The method of claim 1, wherein said predetermined distance is within a range of 200 to 500 feet.

7. An apparatus adapted for measuring a pressure of a well fluid flowing from a formation, comprising:

gauge assembly means disposed on a bottom of said borehole for measuring said pressure, said gauge assembly means including a first coupler means for decoupling with another apparatus when said another apparatus disposes said gauge assembly means on said bottom of said borehole.

8. The apparatus of claim 7, wherein said another apparatus comprises a perforator means for perforating said formation after said perforator means disposes said gauge assembly means on said bottom of said borehole.

9. The apparatus of claim 8, wherein said perforator means includes a second coupler means for decoupling with said first coupler means of said gauge assembly means when said perforator means disposes said gauge assembly means on said bottom of said borehole.

10. The apparatus of claim 9, further comprising:

retrieving assembly means for retrieving said gauge assembly means from said bottom of said borehole after said perforator means is decoupled from said gauge assembly means and perforates said formation, said retrieving assembly means including third coupler means for coupling with said first coupler means of said gauge assembly means when said retrieving assembly means retrieves said gauge assembly means from said bottom of said borehole.

11. A method of measuring a parameter of a fluid flowing from a formation traversed by a borehole, comprising the steps of:

attaching an instrument to a measurement assembly and lowering said measurement assembly followed by said instrument into the borehole until said measurement assembly contacts a bottom of the borehole;

disconnecting said measurement assembly from said instrument;

raising the instrument uphole in the borehole, the measurement assembly remaining on the bottom of the borehole; and when the instrument is disposed a predetermined distance from the measurement assembly, terminating the raising step, the measurement assembly measuring said parameter of the fluid.

12. The method of claim 11, wherein said parameter of said fluid is a pressure.

13. The method of claim 12, wherein said measurement assembly is a pressure measurement gauge assembly means for measuring the pressure of said fluid flowing from said formation.

14. The method of claim 13, wherein said instrument is a perforator, comprising the further step of:

using said perforator, perforating the formation when said perforator is disposed said predetermined distance from said pressure measurement gauge assembly means.

15. The method of claim 14, comprising the further step of:

when the formation is perforated, raising said perforator to a surface of said borehole.

16. The method of claim 15, comprising the further step of:

when said perforator is raised to said surface of said borehole, subsequently retrieving said pressure measurement gauge assembly means from said bottom of said borehole.

* * * * *